US005568174A

United States Patent [19]

Nagahata et al.

[11] Patent Number: 5,568,174

[45] Date of Patent: Oct. 22, 1996

[54] CONNECTOR AND PRINTER HEAD USING THE SAME

[75] Inventors: Takaya Nagahata; Tokihiko Kishimoto, both of Kyoto; Koichi Wada, Yamagata, all of Japan

[73] Assignee: Rohm Co., Ltd., Kyoto, Japan

[21] Appl. No.: 163,031

[22] Filed: Dec. 6, 1993

[30] Foreign Application Priority Data

Mar. 12, 1993 [JP] Japan ..... 5-052234

[51] Int. Cl.[6] ..... B41J 2/335

[52] U.S. Cl. ..... 347/200

[58] Field of Search ..... 346/76 PH; 347/200, 347/201; 439/636, 862

[56] References Cited

U.S. PATENT DOCUMENTS

| | | | |
|---|---|---|---|
| 4,626,872 | 12/1986 | Takeno | 346/76 PH |
| 4,661,823 | 4/1987 | Bangs et al. | 346/76 PH |
| 4,855,757 | 8/1989 | Wiklof et al. | 346/76 PH |
| 4,862,193 | 8/1989 | Hattori et al. | 346/76 PH |
| 4,963,886 | 10/1990 | Fukuda et al. | 346/76 PH |
| 5,207,598 | 5/1993 | Yamada et al. . | |

FOREIGN PATENT DOCUMENTS

| | | |
|---|---|---|
| 407864A2 | 1/1991 | European Pat. Off. . |
| 1089838 | 9/1960 | Germany . |
| 1951766 | 7/1970 | Germany . |
| 60-000984 | 5/1985 | Japan . |
| 60-204327 | 10/1985 | Japan . |
| 62-259879 | 11/1987 | Japan . |
| 63-111064 | 5/1988 | Japan . |
| 2-95643 | 7/1990 | Japan . |
| 2-95642 | 7/1990 | Japan . |

OTHER PUBLICATIONS

French Search Report dated 26 Apr. 1995 in corresponding French application FR 9402776.

*Primary Examiner*—Huan H. Tran

*Attorney, Agent, or Firm*—Brumbaugh, Graves, Donohue & Raymond

[57] ABSTRACT

In a connector used in a print head, each of a plurality of terminal pins has at one end portion thereof an integral grip portion for gripping a circuit board. The terminal pins are spaced a predetermined distance from one anther in juxtaposed relation to one another, with the grip portions disposed at the same side. Each of the terminal pins is inserted into a connector housing from the other end portion of the terminal pin, so that the terminal pins are attached to the connector housing.

6 Claims, 3 Drawing Sheets

CONNECTOR AND PRINTER HEAD USING THE SAME

BACKGROUND OF THE INVENTION

This invention relates to a connector used in a circuit board or the like.

For example, an electrical connection between a printing-purpose circuit board of a thermal head and an external control circuit board for feeding control signals to this printing-purpose circuit board for printing purposes is made through terminal pins mounted on the printing-purpose circuit board, as disclosed in Japanese Utility Model Unexamined Publication Hei-2-95642 and Hei-2-95643. The other ends of these terminal pins are soldered directly to terminals of the external control circuit board, respectively. Alternatively, a connector housing attached to an end of a flexible cable or the like extending from the external control circuit board is connected to the other ends of the terminal pins.

In the case of the above connection by soldering, an expensive soldering apparatus is required, and also for effecting the soldering, the other ends of the terminal pins must be exactly aligned with the terminals of the external control circuit board, respectively. Therefore, there have been encountered problems that much time and labor are required, and that the solder is liable to bridge the gap between the adjacent terminals to produce a short circuit. Moreover, in the connection by soldering, heat is liable to be transferred from the thermal head to the external control circuit board through the soldered portions, so that the external control circuit board is subjected to deformation or the like. A further problem with the connection by soldering is that even if a malfunction develops in the thermal head during the manufacture or in use, the thermal head can not be easily replaced.

On the other hand, in the case of connecting the connector housing of the flexible cable, although the above problems with the connection by soldering are solved, there has been encountered a problem that a mechanically-stable connection construction can not be obtained, and for example, the connector housing is disengaged from the terminal pins by vibrations produced by movement of the thermal head during the feed of paper.

SUMMARY OF THE INVENTION

The prevent invention has been made in view of the above problems, and an object of the invention is to provide a construction by which an electrical connection of a circuit board can be made easily in a stable manner.

To achieve the above object, according to a first aspect of the present invention, there is provided a connector comprising a plurality of terminal pins, each of terminal pins including a linear base portion having a pointed front portion and an integral grip portion for gripping a circuit board, and a connector housing being opened at one side, and having insertion holes for respectively passing said terminal pins. In the connector, the terminal pins are spaced a predetermined distance from one anther in juxtaposed relation to one another, with said grip portions disposed at the same side, and each of said terminal pins is inserted into said insertion hole of said connector housing from the pointed front end of said terminal pin, so that said terminal pins are attached to said connector housing.

According to a second aspect of the invention, the grip portion of each of the terminal pins is positioned inner than the end of the linear base portion of the terminal pin.

In the first aspect of the invention, when the connector is attached to the circuit board, the circuit board can be connected to its mating connecting member through the connector, if a connector mechanism is provided on the mating connecting member.

The grip portions of the terminal pins can be attached to the predetermined portion of the circuit board at one time by holding the connector with the hand. When the terminal pins are pushed at the time of this attachment, the pushing force is applied uniformly to the terminal pins through abutment of the connector housing to the grip portions disposed close to the connector housing.

For connecting the mating connecting member through the connector, the connector housing is abutted against a connector housing of the mating connecting member. At this time, the grip portions disposed close to the connector housing are abutted against the connector housing to support it, and therefore the force from the connector housing of the mating connecting member is received by the grip portions.

According to the second aspect of the invention, in the first aspect of the invention, when the terminal pin is to be inserted into the connector housing to be attached thereto, the force can be applied not to the grip portion of the terminal pin, but directly to the extremity of the one end portion. Therefore, a large force is not required for the gripping operation, and besides the force can be applied linearly to the terminal pin, so that the terminal pin can be smoothly inserted into the connector housing.

DETAILED DESCRIPTION OF THE PREFERRED EMBODIMENTS

Figure 1:
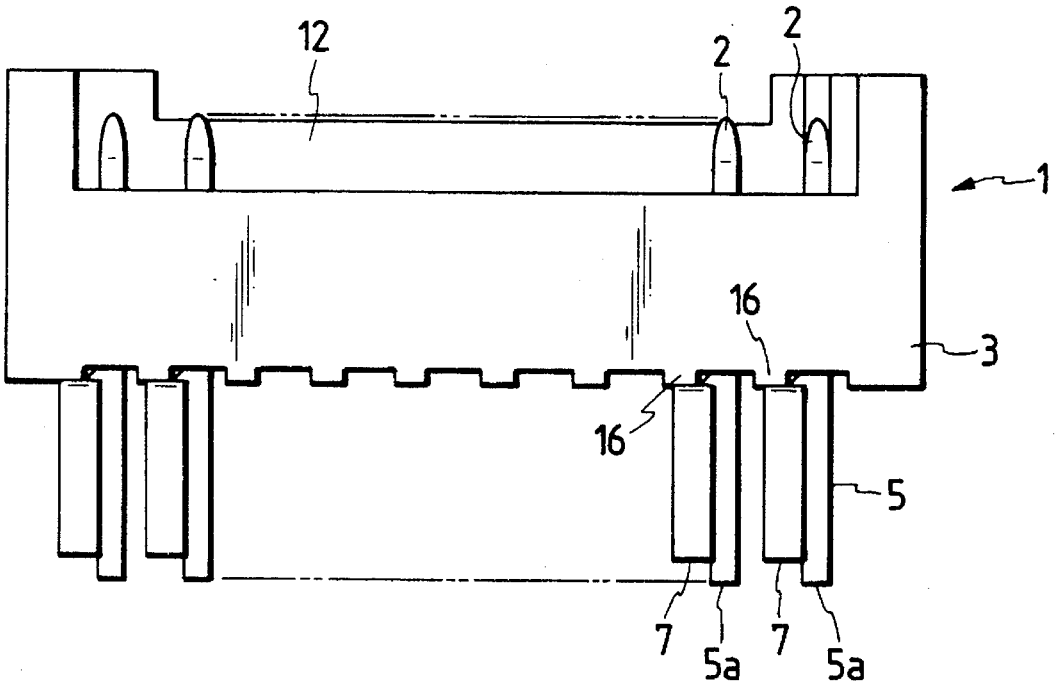
FIG. 1 is a plan view of a connector according to the present invention.
Figure 2:
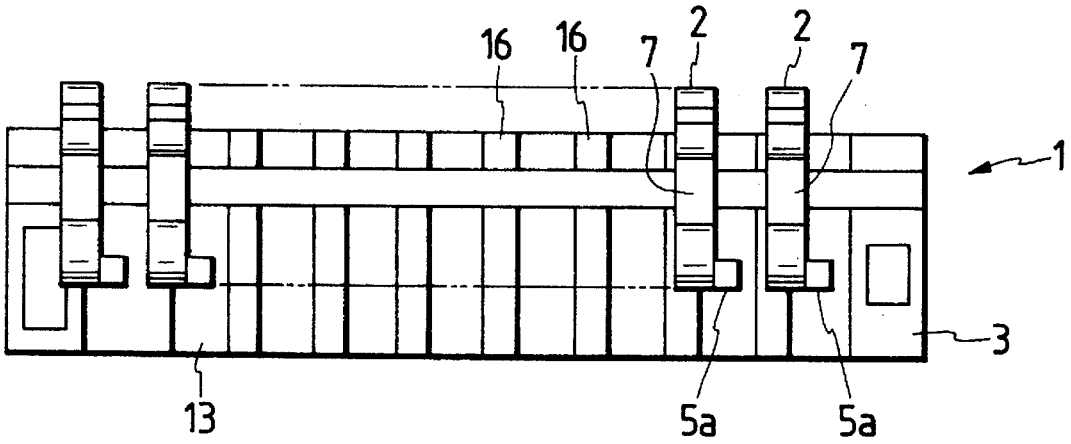
FIG. 2 is a rear view of the connector of the present invention.
Figure 3:
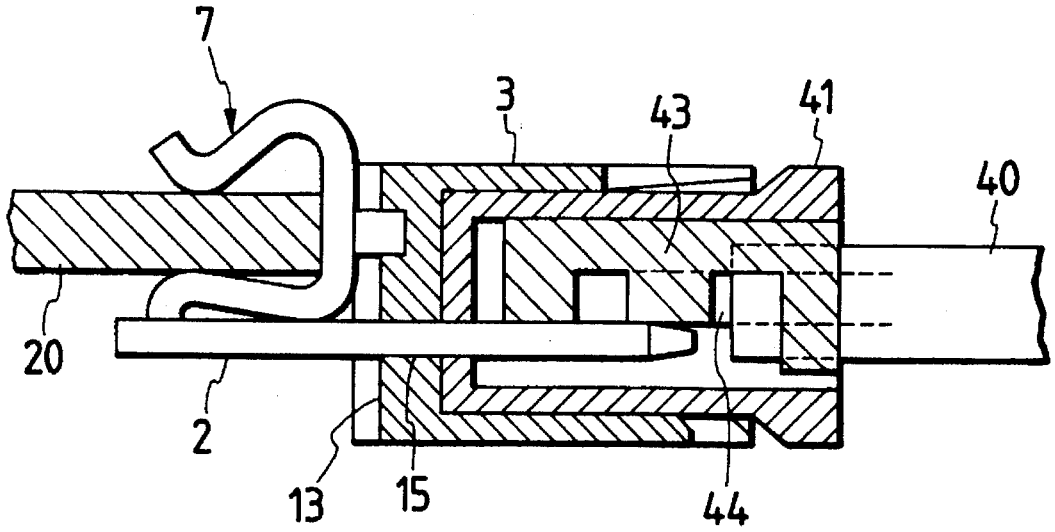
FIG. 3 is a side, cross-sectional view of the connector of the invention in use.

FIG. 1 is a plan view of a connector according to the present invention, FIG. 2 is a rear view, and FIG. 3 is a side cross-sectional view, showing the condition of use. The connector 1 comprises a plurality of terminal pins 2, and a connector housing 3 of a resin having these terminal pins integrally mounted thereon.

Figure 4:
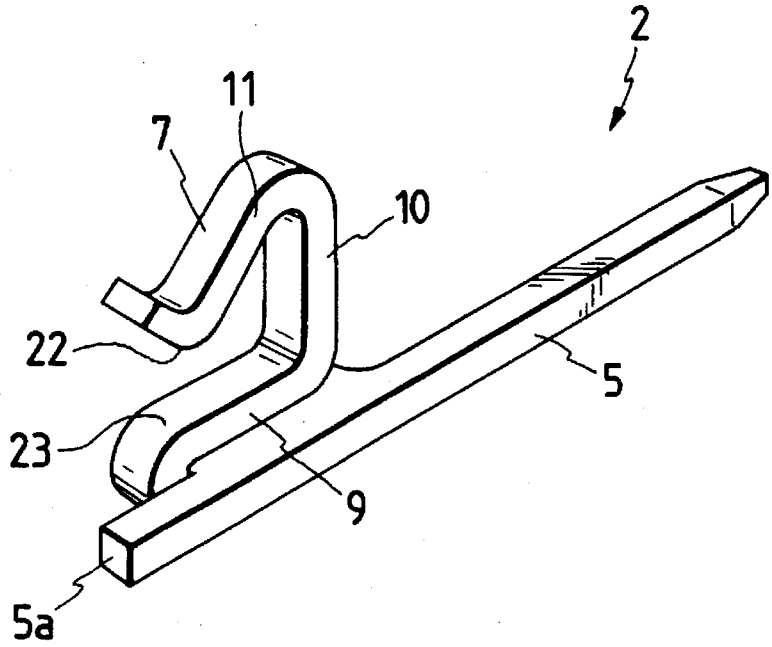
FIG. 4 is a perspective view of a terminal pin used in the invention.

As shown in FIG. 4, the terminal pin 2 includes a linear base portion 5 having a pointed front end, and a grip portion 7 formed integrally on a rear end portion of the base portion 5. That portion of the grip portion 7 formed integrally with and extends rearwardly along one side of the rear end portion of the base portion 5 is bent into a generally U-shape at a position above the base portion 5, as viewed from the side of this grip portion, and this bent portion is defined by a lower structural portion 9, an upstanding portion 10 and an upper structural portion 11. The upper structural portion 11 and the lower structural portion 9 approach each other progressively toward their rear ends, and their rear ends are spaced from each other in a vertical direction.

The connector housing 3 is open at its one longitudinal side, and insertion holes 15 for respectively passing the terminal pins 2 therethrough are formed through a vertical wall 13 at the other longitudinal side opposed to this opening 12, and are juxtaposed in the longitudinal direction. Vertically-extending protuberances 16 are formed on the outer surface of the vertical wall 13, and a protuberance 16 is formed between any two adjacent insertion holes 15.

The pointed front end of the base portion 5 of each terminal pin 2 is passed from behind through the corresponding insertion hole 15, so that the terminal pin is attached to the connector housing 3 in a press-fitted manner, thereby constituting the connector 1. The terminal pin 2 is press-fitted relative to the connector housing 3 until the front surface of the upstanding portion 10 of the grip portion 7 of the terminal pin 2 abuts against the corresponding projection 16. With this construction, the terminal pins 2 are inserted relative to the connector housing 3 with the same dimension, and the front end of the base portion 5 is correctly directed forwardly. For effecting the press-fitting operation, a pushing force is applied to the rear end 5*a* of the base portion 5 of the terminal pin 2, and therefore a linear force acts on the base portion 5, so that the press-fitting operation is carried out smoothly. If the grip portion 7 is provided on the rear end 5*a* of the base portion 5, the rear end 5*a* can not be pushed, and if this is done, there is a possibility that the grip portion 7 is deformed.

Figure 5:
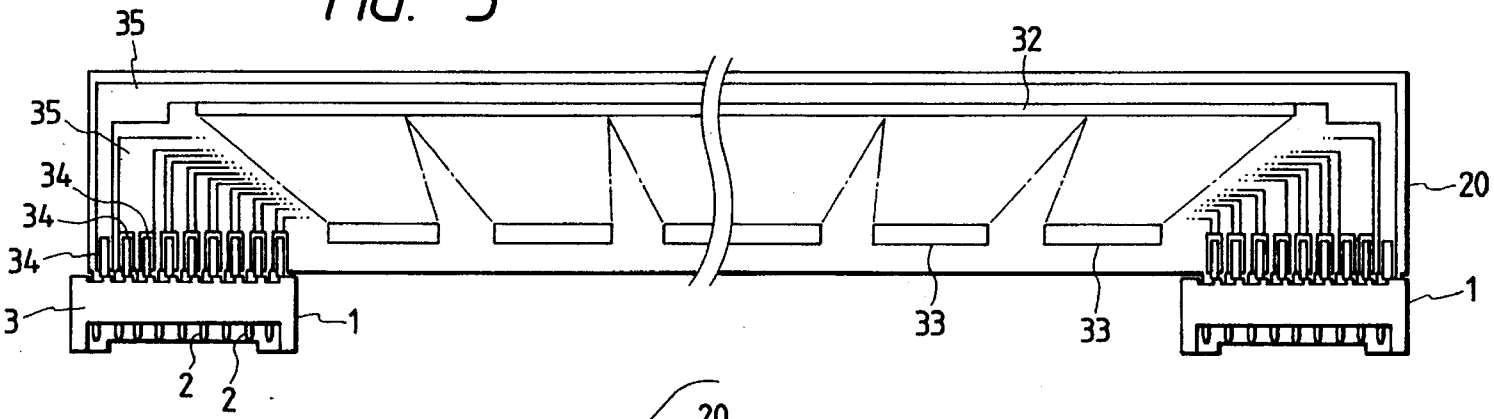
FIG. 5 is a plan view of a thermal head using the connector of the invention.

As shown in FIGS. 3 and 5, the connector 1 of the above construction is attached to a printing-purpose circuit board 20 in such a manner that the grip portion 7 of each terminal pin 2 grips an edge portion of the printing-purpose circuit board 20. For effecting this attachment, the rear ends of the upper and lower horizontal portions 11 and 9 of the grip portion 7 are urged away from each other in an upward-downward direction by the edge portion of the circuit board 20, and the edge portion of the circuit board 20 is received deep in the grip portion 7, and in this condition contact portions 22 and 23 of the upper and lower horizontal portions 11 and 9 are resiliently contacted with the upper and lower surfaces of the circuit board 20, respectively. With this arrangement, the connector 1 is attached to the circuit board 20 in a stable manner, and also the contact portion 22 of the upper horizontal portion 11 is resiliently contacted with a connection terminal 34 formed on the surface of the circuit board 20, thereby forming an electrical contact. The above attachment is carried out by holding the connector housing 3 with the hand, and all the terminal pins 2 can be connected respectively to the predetermined connection terminals 34 of the circuit board 20 at one time. At this time, the front surface of the upstanding portion 10 of the grip portion 7 of the terminal pin 2 abuts against the corresponding protuberance 16 on the rear surface of the connector housing 3, and therefore a pushing force from the connector housing 3 is applied directly to the grip portions 7 of the terminal pins 2, so that the edge portion of the circuit board 20 is smoothly inserted into the grip portions 7.

In the printing-purpose circuit board 20, a plurality of heating resistors 32 serving as printing elements are linearly formed on the surface of a rectangular board of ceramics, and are disposed adjacent to one side edge of the board. A plurality of ICs 33 for driving the heating resistors 32 per a predetermined number of dots are mounted in a row on the board, and are disposed adjacent to the other side edge of the board. The connection terminals 34 (to be connected to an external control circuit board) to which the terminal pins 2 are connected are formed on each of the opposite end portions of the board at the other side thereof. Conductor pattern lines 35 are suitably formed between the connection terminals 34 and the ICs 33, between the connection terminals 34 and the heating resistor 32, and between the ICs 33 and the heating resistor 32. The circuit board 20 is mounted on a support plate (not shown) having a heat radiating function, and a thermal head is constituted by the circuit board 20 and this support plate. The external control circuit board is electrically connected to this thermal head to thereby constitute a printing device.

Figure 6:
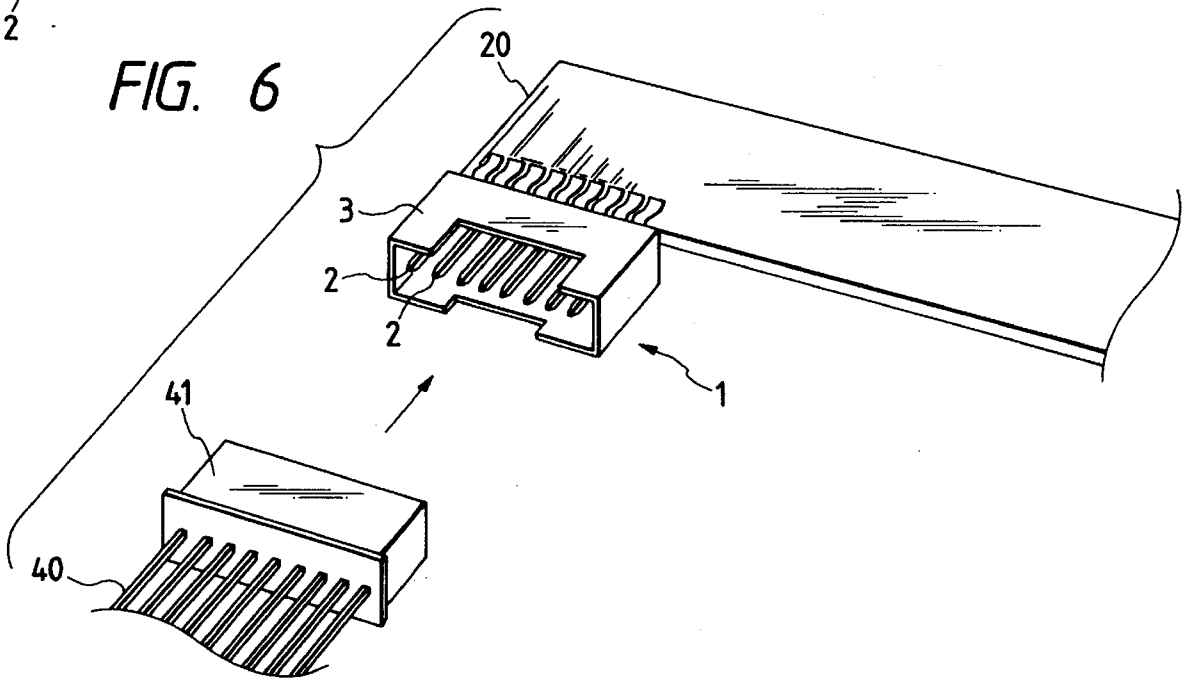
FIG. 6 is a perspective view showing the manner of use of the thermal head employing the connector of the invention.

The connector 1 is attached to the circuit board 20 as described above, and a connector housing 41 attached to a front end of a wire assembly 40 is fitted in the connector housing 3, as shown in FIGS. 3 and 6. By doing so, an electrical connection between the circuit board 20 and the external control circuit board is formed easily and firmly. In FIG. 3, a connection metal member 43 is clamped to a conductor 44 of a covered wire of the wire assembly 40, and is received in the connector housing 41. When the connector housing 41 is fitted in the connector housing 3, the terminal pins 2 of the connector 1 enter the connector housing 41, and are contacted with the corresponding connection metal members 43, respectively.

As described above, in the present invention, the connector is attached to the circuit board, so that this circuit board can be connected to the mating connecting member through the connector. Therefore, the electrical connection of the circuit board can be achieved without the use of soldering.

The grip portions of the terminal pins can be attached to the predetermined portion of the circuit board at one time by holding the connector with the hand. This is convenient.

Furthermore, the connector housing is disposed close to the grip portions, and with this construction when the connector is to be attached to the circuit board, the pushing force is applied uniformly to all the grip portions from the connector housing, and therefore this attachment can be carried out smoothly. Also, when the connector is to be connected to the mating connecting member, all of the terminal pins receive the force applied from the connector housing of the mating connecting member to the connector housing, and therefore there is obtained the more stable connection construction.

Moreover, the grip portion of each terminal pin is juxtaposed to one end portion of the terminal pin, and is disposed adjacent to the extremity of this one end portion, and with this arrangement when the terminal pin is to be inserted into the connector housing to be attached thereto, the force can be applied not to the grip portion of the terminal pin, but directly to the extremity of the one end portion. Therefore, the grip portion will not be deformed, and besides the force can be applied linearly to the terminal pin, so that the terminal pin can be smoothly inserted into the connector housing, thus providing an excellent assembling ability.

What is claimed is:

1. A connector comprising:

a plurality of terminal pins, each of terminal pins including a linear base portion having a pointed front portion and an integral grip portion for gripping a circuit board; and a connector housing being opened at one side, and having insertion holes spaced by a predetermined distance from each other at another side opposite to said one side for respectively passing said terminal pins;

wherein said terminal pins are spaced a predetermined distance from one another in juxtaposed relation to one another, with said grip portions disposed at the same side; and wherein each of said terminal pins is inserted into a corresponding one of said insertion holes of said connector housing from the pointed from portion of each of said terminal pins, so that said terminal pins are attached to said connector housing.

2. A connector as claimed in claim 1, wherein said grip portion of each of the terminal pins is positioned closer to the corresponding insertion hole than an adjacent end of the linear base portion of the terminal pin opposite from the front end portion.

3. A connector as claimed in claim 1, said connector housing further including a vertically extending projection portion formed between any two adjacent insertion holes.

4. A print head comprising:

a circuit board including:

a plurality of printing elements linearly formed on said circuit board;

a plurality of driving circuits for driving said printing elements;

a plurality of connection terminals to be connected to an external control circuit board; and conductor pattern lines formed on said circuit board to connect with said printing elements, said driving circuits and connection terminals; and a connector attached to the circuit board adjacent to the connection terminals, said connector comprising:

a plurality of terminal pins, each of terminal pins including a linear base portion having a pointed front portion and an integral grip portion for gripping said circuit board; and a connector housing being opened at one side, and having insertion holes spaced by a predetermined distance from each other at another side opposite to said one side for respectively passing said terminal pins;

wherein said terminal pins are spaced a predetermined distance from one another in juxtaposed relation to one another, with said grip portions disposed at the same side; and wherein each of said terminal pins is inserted into a corresponding one of said insertion holes of said connector housing from the pointed front end portion of said each of said terminal pins, so that said terminal pins are attached to said connector housing.

5. A print head as claimed in claim 4, wherein said grip portion of each of the terminal pins is positioned closer to the corresponding insertion hole than an adjacent end of the linear base portion of the terminal pin opposite from the pointed front portion.

6. A print head as claimed in claim 4, said connector housing further including a vertically extending projection portion formed between any two adjacent insertion holes.

* * * * *